US005587655A

United States Patent [19]

Oyabe et al.

[11] Patent Number: 5,587,655

[45] Date of Patent: Dec. 24, 1996

[54] CONSTANT CURRENT CIRCUIT

[75] Inventors: Kazunori Oyabe; Kazuhiko Yoshida; Tatsuhiko Fujihira, all of Nagano, Japan

[73] Assignee: Fuji Electric Co., Ltd., Kawasaki, Japan

[21] Appl. No.: 514,208

[22] Filed: Aug. 11, 1995

[30] Foreign Application Priority Data

Aug. 22, 1994 [JP] Japan ..... 6-196420

[51] Int. Cl.[6] ..... G05F 3/04; G05F 3/16

[52] U.S. Cl. ..... 323/312; 323/315; 323/907

[58] Field of Search ..... 323/312, 315, 323/907

[56] References Cited

U.S. PATENT DOCUMENTS

| | | | |
|---|---|---|---|
| 4,716,356 | 12/1987 | Vyne et al. | 323/312 |
| 5,047,706 | 9/1991 | Ishibashi et al. | 323/315 |
| 5,173,656 | 12/1992 | Seevinck et al. | 323/907 |
| 5,384,529 | 1/1995 | Nakage | 323/312 |
| 5,512,855 | 4/1996 | Kimura | 323/312 |

OTHER PUBLICATIONS

Analysis and Design of Analog Integrated Circuits, Second Edition by Paul R. Gray and Robert G. Meyer.

CMOS Analog Circuit Design, Phillip E. Allen and Douglas R. Holberg.

*Primary Examiner*—Stuart N. Hecker

*Attorney, Agent, or Firm*—Kanesaka & Takeuchi

[57] ABSTRACT

A constant current circuit of the invention supplies a constant current to a load. The constant current circuit is formed of a current source device for providing an input current having a predetermined value with temperature dependence, a voltage divider device connected to the current source device, and an output transistor device. A reference transistor device or an adjusting transistor device is attached to the current source device. In case the reference transistor device is used, the voltage divider device divides a reference voltage of the reference transistor device to thereby generate a control voltage. In case the adjusting transistor device is used, an adjusting voltage from the voltage divider device is supplied to the adjusting transistor device to generate a control voltage. The output transistor device is connected to the load for controlling an output current supplied to the load in response to the control voltage. Temperature dependence of the output current is adjusted by setting voltage dividing ratio of the voltage divider device.

11 Claims, 3 Drawing Sheets

CONSTANT CURRENT CIRCUIT

BACKGROUND OF THE INVENTION AND RELATED ART STATEMENT

The present invention relates to a constant current circuit which generates a current having a predetermined value without temperature dependence or with predetermined temperature dependence, and which is suitable to be incorporated into an integrated circuit.

As is well known, a reference voltage is frequently used for precisely operating various electronic circuits, but it is also necessary in many cases to use a reference current for the same purpose as in the reference voltage. Of course, it is desired that this reference current should not be affected by variation of a power supply voltage, and also by a change of the temperature, as well.

At first, some conventional reference current sources suitable for generating reference currents having substantially no temperature dependence, will be briefly described below with reference to FIGS. 4(*a*) through 4(*d*), which show circuit configurations of the conventional reference current sources incorporated into a MOS integrated circuit.

FIG. 4(*a*) shows a current source circuit for a reference current without temperature dependence, which circuit utilizes an operational threshold value of a MOS gate (in detail, cf. P. E. Allen & D. R. Douglas: "CMOS Analog Circuit Design", published from Holt, Rinhart & Holberg Inc. in 1987, pp. 246–249). This circuit is composed in combination with a current mirror circuit including three p-channel transistors 61*a* to 61*c* and a reference circuit including two n-channel transistors 62*a* and 62*b*. While the mirror circuit on the power supply side is supplying currents to a resistor r and both transistors 62*a* and 62*b*, gate and source of which are connected with one another, an output current Io is taken out from the transistor 61*c* on the driven side.

FIG. 4(*b*) shows a self-bias type reference current source using a voltage between a base and an emitter of a parasitic transistor for a reference (Cf. P. R. Grey & R. G. Mayer, "Analysis and Design of Analog Integrated Circuit", the Japanese translation published from Baifukan Publishing Co., in 1990, pp. 307). This circuit is composed of the above mentioned mirror circuit including the transistors 61*a* to 61*c*, another mirror circuit provided with 2 n-channel transistors 64*a* and 64*b*, and a reference circuit including a pnp transistor 63 parasitized in a CMOS integrated circuit and a resistor r. An output current is taken out in the same manner as described above.

FIG. 4(*c*) illustrates a current source circuit using a thermal voltage for a reference, which circuit is different from the circuit of FIG. 4 (*b*) as to usage of two transistors 63*a* and 63*b*, which differ in current densities of the emitters, in the reference circuit.

Furthermore, FIG. 4(*d*) shows a current source circuit using a band gap voltage for a reference (P. R. Grey and R. G. Mayer, cited above, pp. 310). This circuit is formed by adding a fine adjusting circuit for adjusting temperature characteristics to the circuit shown in FIG. 4(*c*). This fine adjusting circuit includes a transistor 65, a resistor ra, an operational amplifier 66 which subtracts a voltage drop across a feed back resistor R receiving an output current Io from a voltage drop across the transistor 65 and the resistor ra, and an output transistor 67 controlled by an output of the operational amplifier 66. In this case, the output current Io is a so-called sink current, which is absorbed from a load.

As described above, the prior art current source circuits can output a reference current which is not affected by the variation of a power supply voltage and has considerably small temperature dependence, though some difference may exist among the circuits. But, since many constituent elements are used in each circuit, there is a problem that a large chip area is required for incorporating the constituent elements into an integrated circuit. That is, 5 to 6 MOS transistors, 0 to 3 bipolar transistors, and 1 to 3 resistors are required in the current source circuits in FIGS. 4(*a*) to 4(*d*). Therefore, the chip size becomes large and the cost becomes high in case of incorporating a plurality of the circuits at the required places in an integrated circuit.

As a simplest constant current element, a depletion type MOS transistor is conventionally utilized in a current saturation region. Since an n-channel MOS transistor can be used simply by connecting a gate with a source, the circuit configuration is much simplified. However, it has considerably large temperature dependence, by which a current value to be constant changes by a ratio of about 1.7:1 in a range of 0° to 150° C. Of course, this element can not be used in a circuit in which temperature dependent instability of the current causes problem.

Furthermore, in some cases, a constant current has to be generated, which has not only no temperature dependence but also a predetermined temperature coefficient, though not affected by the power supply voltage. For examples, when a reference voltage is generated by using a forward voltage of a diode, a negative temperature coefficient of the diode is canceled with a constant current having a positive temperature coefficient. Or, a temperature error of a detected signal of a sensor etc. is compensated by using a constant current having a positive or a negative temperature coefficient as the case may be.

In view of the foregoings, an object of the present invention is to provide a circuit, as simple as possible, which facilitates generation of a constant current having no temperature dependence or a predetermined temperature coefficient without influence of variation of the power supply voltage.

SUMMARY OF THE INVENTION

The object of the present invention is achieved in a first embodiment by a constant current circuit for supplying a constant current to a load, which constant current circuit comprises current source means for generating an input current, which has a predetermined value with temperature dependence; reference transistor means for receiving the input current, and for generating a reference voltage at a connection point, at which the reference transistor means is connected with the current supply means; voltage divider means for receiving the reference voltage and dividing the reference voltage to generate a control voltage; and output transistor means for receiving the control voltage and controlling an output current in response to the control voltage. Temperature dependence of the output current is adjusted by setting a voltage dividing ratio of the voltage divider means.

It is preferable in the first embodiment for the current source means to be comprised of a depletion type field effect transistor which receives a power supply voltage, a gate being connected with a source of the transistor. The current source means may be comprised of an enhancement type field effect transistor which receives a power supply voltage, a gate being connected with a drain of the transistor. In the first embodiment, the reference transistor means may be comprised of a n-channel or p-channel field effect transistor, a gate of which is connected with a drain of the transistor. The reference transistor means may be a bipolar transistor.

It is also preferable in the first embodiment for the voltage divider means to be comprised of a resistance voltage divider circuit which includes a series circuit having a pair of resistors and receiving the reference voltage. The resistance voltage divider circuit generates a control voltage at a common connection point, at which the resistors are connected with one another.

The object of the present invention is also achieved in a second embodiment by a constant current circuit for supplying a constant current to a load, which constant current circuit is comprised of current source means for generating an input current, which has a predetermined value with temperature dependence; adjusting transistor means for receiving the input current and generating a control voltage at a connection point, at which the adjusting transistor means is connected with the current source means; output transistor means for receiving the control voltage and controlling an output current flowing to the load in response to the control voltage; and voltage divider means for receiving and dividing the control voltage, the divided control voltage being supplied as an adjusting voltage to the adjusting transistor means. The dividing ratio of the voltage divider means is set to adjust temperature dependence of the output current.

It is preferable in the second embodiment for the current source means to be comprised of a resistor which has a considerably high resistance to generate a nearly constant current, and which resistor receives a power supply voltage. It is also preferable for the adjusting transistor means to be comprised of a field effect transistor as explained before, a gate of which is controlled by the adjusting voltage. In the second embodiment, the voltage divider means may be comprised of a resistance voltage divider circuit, which includes a series circuit having a pair of resistors and receives the control voltage. The resistance voltage divider circuit generates an adjusting voltage at a common connection point, at which the resistors are connected with one another.

In case the reference transistor means or the adjusting transistor means is comprised of a field effect transistor, it is also preferable in the first or second embodiment for the output transistor means to be comprised of a field effect transistor, a current between a source and a drain being controlled in response to the control voltage received at a gate of the transistor.

Function of the present invention described above is explained referring to FIGS. 1(*a*) and 1(*b*). In the first embodiment shown in FIG. 1(*a*), an input current Ii is fed from current source means 10 to reference transistor means 20, and a reference voltage Vr is supplied from a connection point of both means described above to voltage divider means 30. A control voltage Vc, into which the reference voltage Vr is divided in the voltage divider means 30, controls output transistor means 40, which allows an output current Io to flow to a load 1. When the voltage dividing ratio α of the voltage divider means 30 is 1 and the reference voltage Vr becomes the control voltage Vc as it is, the reference transistor means 20 and the output transistor means 40 constitute a well known current mirror circuit. Therefore, the output current Io, i.e. the driven side current, shows the nearly same temperature dependence as the input current Ii, i.e. the reference side current. However, it is known that when the voltage dividing ratio α becomes less than 1, since the current mirror circuit deviates from the ideal condition, the output current Io shows e.g. more positive temperature dependence than that of the input current Ii.

The present invention adjusts the temperature dependence of the output current utilizing the above-mentioned characteristics. By inserting the voltage divider means 30 between the reference transistor means 20 at the reference current side and the output transistor means 40 at the driven current side, and by setting the voltage dividing ratio α so as not to satisfy the ideal condition of the current mirror circuit, the temperature coefficient of the output current Io is easily adjusted, by only the two transistors constituting the modified current mirror circuit, to zero or a desired value, e.g. so as to compensate the negative temperature coefficient of the input current Ii to a positive side.

In the second embodiment shown in FIG. 1(*b*), an input current Ii is fed from current source means 11 to adjusting transistor means 21, and a control voltage Vc is supplied from the connection point of both means described above to output transistor means 40. An adjusting voltage Va, into which the control voltage Vc is divided in voltage divider means 30, is given to the adjusting transistor means 21. In this second embodiment too, when the voltage dividing ratio α of the voltage divider means 30 is 1, the output current Io on the driven side of a current mirror circuit shows nearly the same temperature dependence as the input current Ii on the reference side. But, when the voltage dividing ratio α becomes less than 1, the output current Io shows e.g. more negative temperature dependence than that of the input current Ii. Therefore, by setting the voltage dividing ratio α, the temperature coefficient of the output current Io is easily adjusted to zero or a desired value, e.g. so as to compensate the positive temperature coefficient of the input current Ii to a negative side.

BRIEF DESCRIPTION OF THE DRAWINGS

FIG. 1(*b*) is a circuit diagram of a constant current circuit of a second embodiment of the present invention, wherein an output current is taken out in a sink current mode;

FIG. 2(*b* ) is a circuit diagram of a constant current circuit of a modification of the second embodiment of the present invention, wherein an output current is taken out in a source current mode;

DETAILED DESCRIPTION OF PREFERRED EMBODIMENTS

Figure 1A:
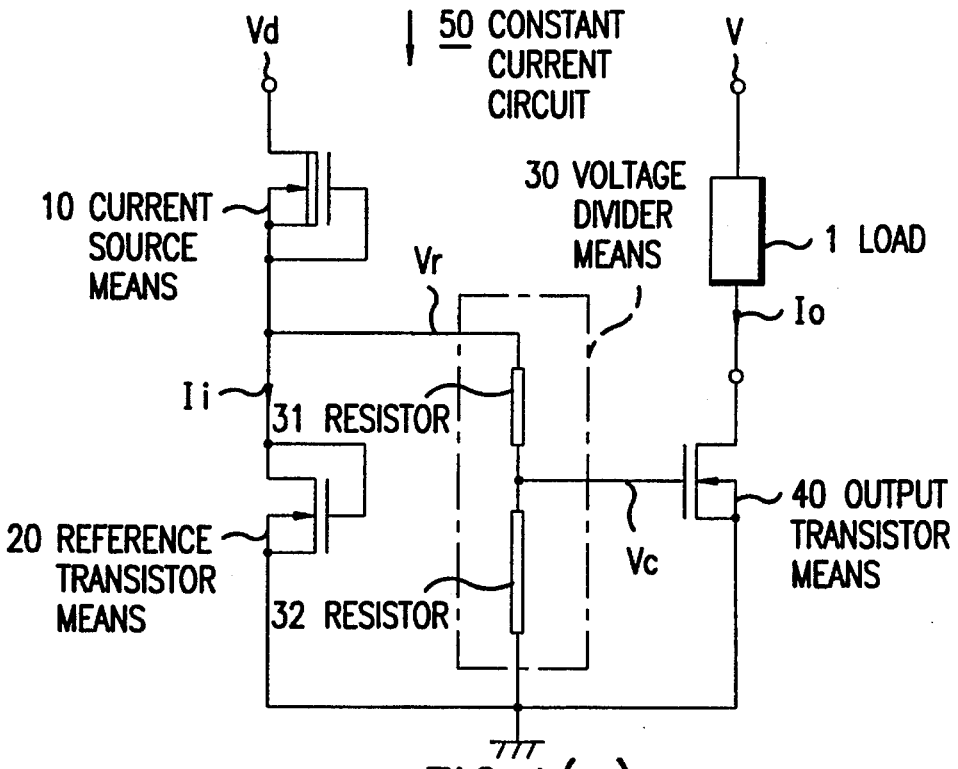
FIG. 1(*a*) is a circuit diagram of a constant current circuit of a first embodiment of the present invention, wherein an output current is taken out in a sink current mode.
Figure 1B:
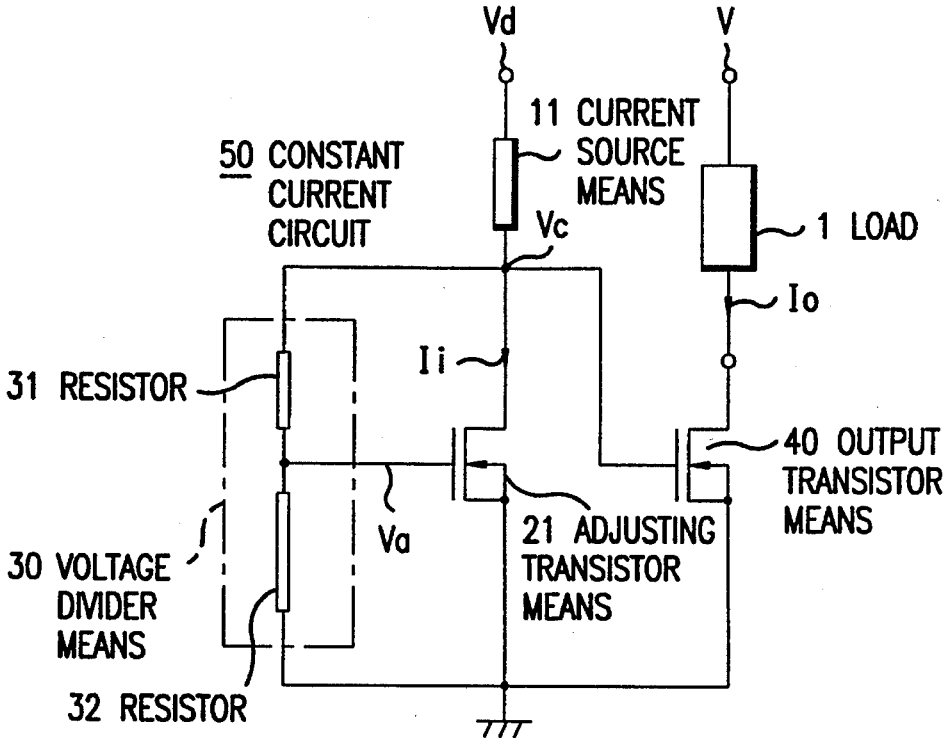
Figure 2A:
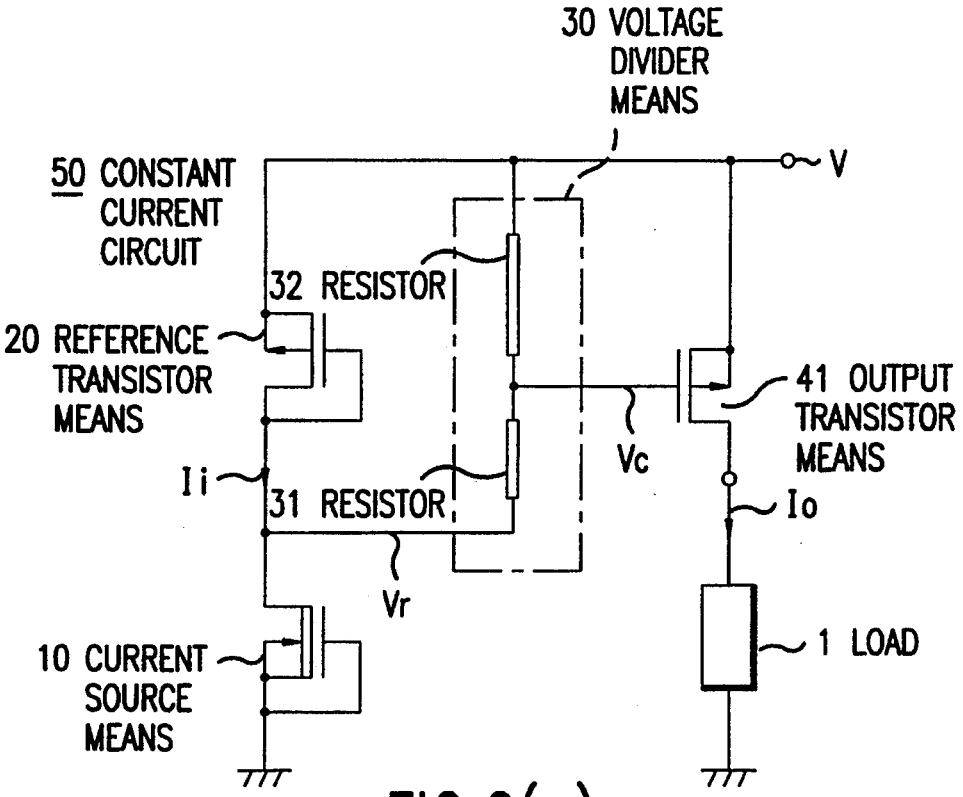
FIG. 2(*a*) is a circuit diagram of a constant current circuit of a modification of the first embodiment of the present invention, wherein an output current is taken out in a source current mode.
Figure 2B:
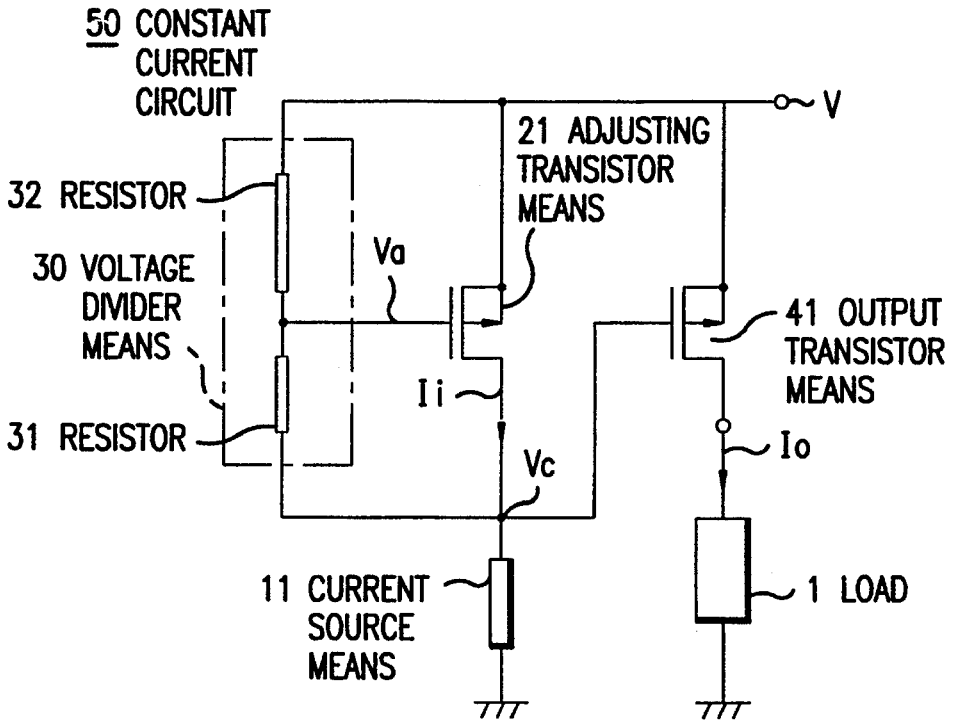
Figure 3:
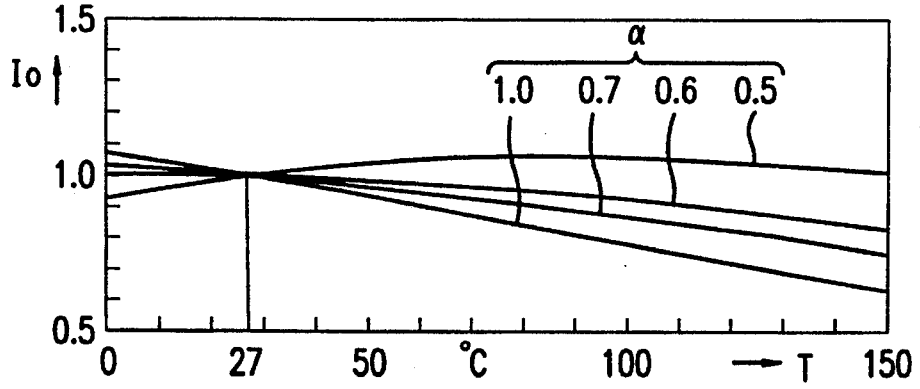
FIG. 3 shows a set of curves showing the changes in an output current versus a temperature with the voltage dividing ratio of the voltage divider means as the parameters.
Figure 4A:
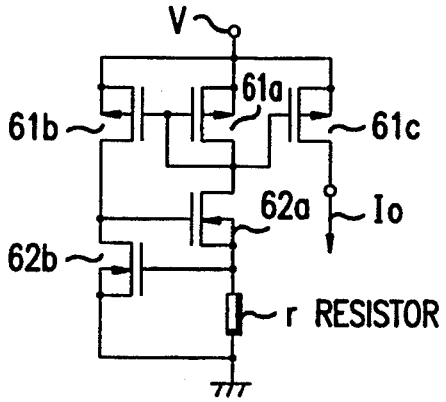
FIG.4(a) PRIOR ART
FIGS. 4(*a*) to 4(*d*) are circuit diagrams of the first to fourth prior art.
Figure 4B:
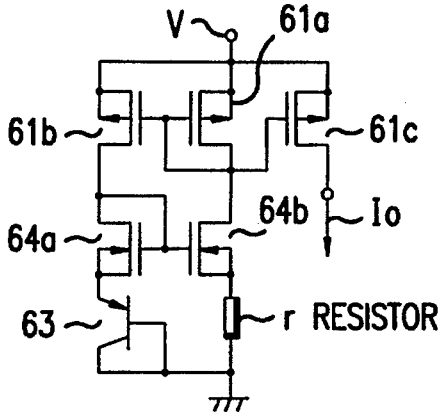
FIG.4(b) PRIOR ART
Figure 4C:
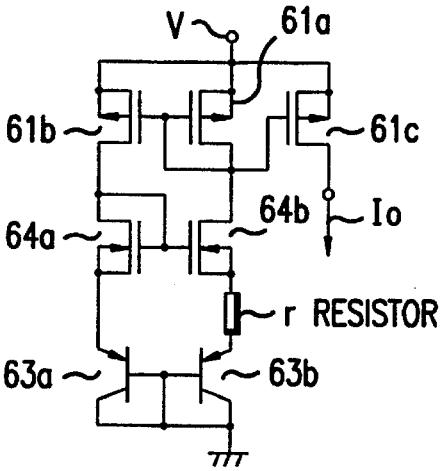
FIG.4(c) PRIOR ART
Figure 4D:
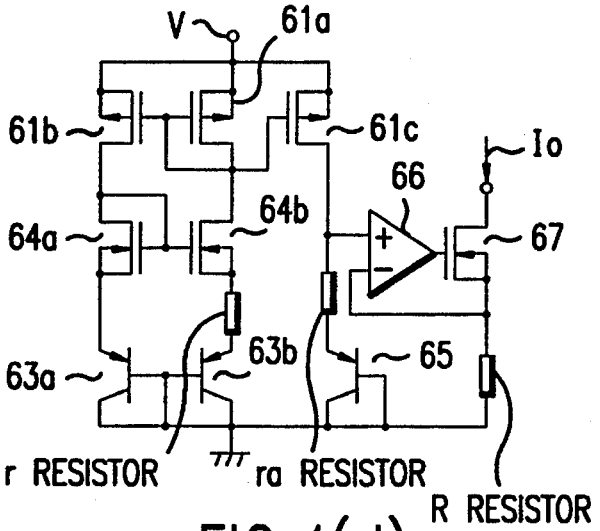
FIG.4(d) PRIOR ART

Hereinafter, embodiments of the present invention are described in detail with reference to the accompanied drawings. FIG. 1(*a*) and FIG. 1(*b*) show first and second embodiments, wherein an output current is taken out in a sink current mode. FIG. 2(*a*) and FIG. 2(*b*) show modifications of the first and second embodiments, wherein an output current is taken out in a source current mode respectively. FIG. 3 shows the way of adjustment of the temperature dependence of an output current in the first embodiment as an example.

In the first embodiment shown in FIG. 1(*a*), current source means 10 receiving a power supply voltage Vd is comprised of an n-channel depletion type field effect transistor, a gate of which is electrically connected with a source of the transistor in this example. The transistor operates in a region of current saturation by applying a high-enough voltage between the source and drain of the transistor. Then, an input current Ii from this current source means 10 is not substantially affected by the variation of the power supply voltage Vd, but shows considerably large temperature dependence as described in the prior art.

Reference transistor means 20 receiving this input current Ii is comprised of an n-channel enhancement type field effect transistor in this embodiment, a gate of which is connected with a drain of the transistor in this example. A reference voltage Vr is given from the connection point of the current source means 10 and the transistor means 20 to voltage divider means 30. Voltage divider means 30 shown in a chain line box is comprised of a resistance voltage divider circuit, which includes a pair of resistors 31 and 32 connected in series as usual. The resistance values of the resistors are preferably set about two figures as large as that of the on-resistance of the reference transistor means 20. By this voltage divider means 30, a control voltage Vc, into which the reference voltage Vr is divided through a set voltage dividing ratio α, is given to output transistor means 40. The output transistor means 40 is an n-channel field effect transistor in the illustrated example. The output transistor means 40 receives the control voltage Vc on a gate, and controls in response to the control voltage Vc an output current Io fed to a load 1.

In the illustrated example, a separate power supply voltage V separated from the power supply voltage of the current source means 10 is applied to the load 1, and the constant current circuit 50 shown in FIG. 1(*a*) is a so-called sink current source wherein the output current Io flowing to the load 1 is absorbed in the output transistor means 40. The operation and function for adjusting the temperature dependence are already described in the summary. So, the duplicated explanations are omitted for the shake of simplicity.

To stabilize the temperature dependence of the output current Io, the current source means 10, the reference transistor means 20 and the output transistor means 40 are preferably located in a nearby adjoining area adjoining each other on a chip of an integrated circuit. Further, when the power supply voltage Vd is 5 V, it has been empirically found to be preferable to set the on-resistance of the reference transistor means 20 so that the reference voltage Vr is about 2 V to facilitate the adjustment of the temperature dependence.

In the second embodiment shown in FIG. 1(*b*), current source means 11, which generates an input current Ii showing positive temperature dependence, is comprised of, e.g. a resistor receiving a power supply voltage Vd. Adjusting transistor means 21 is comprised of an n-channel enhancement type field effect transistor receiving the input current Ii. A control voltage Vc is supplied from the connection point of the current source means 11 and this transistor to a gate of a field effect transistor of output transistor means 40. Voltage divider means 30 receives the control voltage Vc, and supplies an adjusting voltage Va, into which the control voltage Vc is divided through a set voltage dividing ratio α of less than 1, to the adjusting transistor means 21 comprised of the field effect transistor. In this embodiment, the temperature dependence of the output current Io is eliminated or set at a desired value by adjusting the positive temperature dependence of the input current Ii with the negative temperature dependence set by a voltage dividing ratio α of less than 1 in the voltage divider means 30.

As seen from each embodiment shown in FIG. 1(*a*) and FIG. 1(*b*), only two transistors, one for the reference transistor means 20 or the adjusting transistor means 21 and one for the output transistor means 40, are combined in addition to the current source means 10 or 11. Therefore, the much simplified constant current circuit can be constructed as compared with the prior art circuits. Still more, in the embodiments shown in FIG. 1(*a*) and FIG. 1(*b*), the power supply voltage Vd on the side of the current source 10 or 11 is separated from the power supply voltage V on the side of the load 1, but the power supply voltages Vd and V may be united.

In a modification of the first embodiment shown in FIG. 2(*a*), current source means 10 is comprised of the same n-channel depletion type field effect transistor as in FIG. 1(*a*). A gate of the transistor is electrically connected with a source of the transistor, and the transistor operates in a region of current saturation to generate an input current Ii having negative temperature dependence with a definite value, but it is connected on the grounding side, different from the circuit shown in FIG. 1(*a*). Reference transistor means 20 receiving the input current Ii is comprised of a p-channel enhancement type field effect transistor, and connected to the power supply voltage V side.

Voltage divider means 30 receives a reference voltage Vr from a connection point of the reference transistor means 20 and the current source means 10, and supplies a control voltage Vc, into which the reference voltage Vr is divided, to a gate of output transistor means 41, which is comprised of a p-channel field effect transistor in this modified embodiment. The both p-channel field effect transistors of the reference transistor means 20 and the output transistor means 41 constitute a modified current mirror circuit with the voltage divider means 30 located between the transistors. Then, the temperature coefficient of the output current Io is set to zero or a desired value by adjusting the temperature dependence of the input current Ii through a voltage dividing ratio α of the voltage divider means 30 in the same manner as the embodiments described above. Besides, in this modified embodiment, the output current Io is supplied from the output transistor means 41 connected with the side of the power supply voltage V to a load 1 in a so-called source current mode.

In a modification of the second embodiment shown in FIG. 2(*b*), a resistor for current source means 11 is connected to a grounding side, a p-channel field effect transistor for adjusting transistor means 21 is connected to a power supply voltage V, and a control voltage Vc is supplied from a connection point of the current source means 11 and the adjusting transistor means 21 to a gate of a p-channel field effect transistor for output transistor means 41. The adjusting transistor means 21 is controlled by an adjusting voltage Va, into which the control voltage Vc is divided in voltage divider means 30. The temperature coefficient of the output current Io is also set to zero or a desired value by adjusting the temperature dependence of the input current Ii through a voltage dividing ratio α of the voltage divider means 30 in the same manner as the embodiment in FIG. 1(*b*). The output current Io is supplied from the output transistor means 41 connected with the power supply voltage V side to a load 1 in a source current mode in this modified embodiment too.

FIG. 3 is a set of curves showing the changes in an output current Io relative to a temperature with a voltage dividing ratio α of the voltage divider means 30 in the constant current circuit 50 shown in FIG. 1(*a*) as the parameter. The abscissa shows temperature T° C., and the ordinate shows output current Io which is normalized to one at 27° C. In this figure, the circuit parameters are set so that the reference voltage Vr becomes 2 V when the power supply voltage is 5 V. When the voltage divider means 30 does not function, e.g. α is 1, the output current Io shows the negative temperature dependence that the input current Ii has. When α is 0.7 or less, the adjusting effect becomes clear, and when α is 0.5, the temperature dependence turns to positive below about 80° C. and is negative above 80° C. In the range of 0° to 150° C. shown in the figure, when α is 0.5, the temperature coefficient of the output current Io becomes nearly zero, with the variation width of ±7.5%. If this is compared with the variation width of +8 to −36% when α is 1, the variation width of output current Io is reduced to about ⅓.

Without limiting to the embodiments described above, the present invention can be realized in various modes. For example, the depletion type field effect transistor is used for the current source means 10 in the first embodiment, but an enhancement type field effect transistor, a gate and drain of which are connected with one another, can be used within a saturated current region. Further, since the output current can be taken out in the sink current mode as shown in FIG. 1(*a*) and FIG. 1(*b*), or in the source current mode as shown in FIG. 2(*a*) and FIG. 2(*b*), when a plurality of the constant current circuits is connected in series, and the output current of the preceding stage is inputted to the following stage, the temperature dependence can be finely adjusted by the voltage dividing ratios of their voltage divider means.

As has been explained so far, according to the invention, by utilizing the fact that the reference and driven sides can be provided with different temperature variations by operating a current mirror circuit in a state deviated from the normal state, the voltage divider means is inserted between the reference side, i.e. the reference transistor means in the first embodiment or the adjusting transistor means in the second embodiment, and the driven side, i.e. the output transistor means. In this circuit configuration, the output current on the driven side is provided with the desired temperature dependence by setting the voltage dividing ratio as to compensate the temperature dependence of the input current received from the current source means on the reference side. This circuit configuration of the present invention shows the following effects:

(a) Since a constant current circuit can be comprised of only two transistors for the reference transistor means or the adjusting transistor means and for the output transistor means, and a simple voltage divider means except the current source means, the circuit configuration can be more simplified than that of the prior art, and the necessary chip area can be much reduced when the circuit is incorporated into an integrated circuit. Especially, when a plurality of the constant current circuits is incorporated into an integrated circuit, the chip area is prevented from increasing, and its cost is reduced. Besides, in case the divider means is a resistor dividing circuit, the resistors of the voltage divider means can be built in the chip by using polycrystalline silicon of the transistors.

(b) Since the temperature dependence of the output current can be continuously and easily adjusted with the voltage dividing ratio of the voltage divider means, it is possible to obtain the output current having the temperature coefficient of not only zero but a desired value.

(c) Since the circuit configuration of the constant current circuit is very simple, and the output current can be simply obtained in a sink or a source current mode, if necessary, a plurality of the constant current circuits is connected in series, and the temperature dependence of the output current can be finely adjusted without causing considerable complexity of the circuit configuration.

What is claimed is:

1. A constant current circuit for supplying a constant current to a load comprising:

current source means for providing an input current, said input current having a predetermined value with temperature dependence;

reference transistor means having a connection point with the current source means, said reference transistor means receiving said input current and generating a reference voltage at the connection point;

voltage divider means connected to the connection point, said voltage divider means dividing said reference voltage to thereby generate a control voltage; and output transistor means connected to the voltage divider means and the load for controlling an output current supplied to the load in response to said control voltage, temperature dependence of said output current being adjusted by setting voltage dividing ratio of said voltage divider means.

2. The constant current circuit as claimed in claim 1, wherein said current source means comprises a depletion type field effect transistor having a gate and a source connected to the gate, said depletion type field effect transistor receiving a power supply voltage.

3. The constant current circuit as claimed in claim 1, wherein said current source means comprises an enhancement type field effect transistor having a gate and a drain connected to the gate, said enhancement type field effect transistor receiving a power supply voltage.

4. The constant current circuit as claimed in claim 1, wherein said reference transistor means comprises a field effect transistor having a gate and a drain connected to the gate.

5. The constant current circuit as claimed in claim 1, wherein said voltage divider means comprises a resistance voltage divider circuit having a pair of resistors connected in series for receiving said reference voltage, said resistance voltage divider circuit having a common connection point between the resistors and generating said control voltage at the common connection point.

6. The constant current circuit as claimed in claim 1, wherein said output transistor means comprises a field effect transistor having a source, a drain and a gate, a current between the source and the drain being controlled in response to said control voltage received at the gate thereof.

7. A constant current circuit for supplying a constant current to a load comprising:

current source means for providing an input current, said input current having a predetermined value with temperature dependence;

adjusting transistor means having a connection point with said current source means, said adjusting transistor means receiving the input current and generating a control voltage at the connection point;

output transistor means connected to the adjusting transistor means and the load for controlling an output current supplied to the load in response to said control voltage; and voltage divider means connected to the adjusting transistor means, said voltage divider means receiving and dividing said control voltage and generating an adjusting voltage to said adjusting transistor means, temperature dependence of said output current being adjusted by setting a voltage dividing ratio of said voltage divider means.

8. The constant current circuit as claimed in claim 7, wherein said current source means comprises a resistor receiving a power supply voltage.

9. The constant current circuit as claimed in claim 7, wherein said adjusting transistor means comprises a field effect transistor receiving said adjusting voltage at a gate thereof.

10. The constant current circuit as claimed in claim 7, wherein said voltage divider means comprises a resistance voltage divider circuit and having a pair of resistors connected in series for receiving said control voltage, said resistance voltage divider circuit having a common connection point between the resistors and generating said adjusting voltage at the common connection point.

11. The constant current circuit as claimed in claim 7, wherein said output transistor means comprises a field effect transistor having a source, a drain and a gate, a current between the source and the drain being controlled in response to said control voltage received at the gate thereof.

* * * * *